United States Patent [19]

Yakata

[11] Patent Number: 4,763,897

[45] Date of Patent: Aug. 16, 1988

[54] EXERCISE MACHINE WITH ADJUSTABLY POSITIONED BAR

[76] Inventor: Brian T. Yakata, 200 West 79th St., New York, N.Y. 10024

[21] Appl. No.: 904,690

[22] Filed: Sep. 5, 1986

[51] Int. Cl.[4] ..... A63B 21/06

[52] U.S. Cl. ..... 272/118; 272/134

[58] Field of Search ..... 272/117, 118, 123, 130, 272/134, 144, 145, DIG. 4, 125; 128/25 R

[56] References Cited

U.S. PATENT DOCUMENTS

| | | | |
|---|---|---|---|
| 2,533,273 | 12/1950 | MacGregor | 272/144 |
| 4,089,330 | 5/1978 | Nicolosi et al. | 128/25 R |
| 4,198,044 | 4/1980 | Holappa | 272/144 X |
| 4,200,279 | 4/1980 | Lambert, Jr. | 272/118 |
| 4,226,415 | 10/1980 | Wright | 272/130 |
| 4,511,137 | 4/1985 | Jones | 272/118 |
| 4,542,899 | 9/1985 | Hendricks | 272/118 |
| 4,565,368 | 1/1986 | Boettcher | 272/125 X |
| 4,600,189 | 7/1986 | Olschansky et al. | 272/134 X |
| 4,603,855 | 8/1986 | Sebelle | 272/118 X |
| 4,621,807 | 11/1986 | Stramer | 272/118 X |
| 4,627,616 | 12/1986 | Kauffman | 272/134 X |
| 4,628,910 | 12/1986 | Krukowski | 128/25 R |
| 4,632,393 | 12/1986 | Van Noord | 272/134 |

FOREIGN PATENT DOCUMENTS

| | | | |
|---|---|---|---|
| 1051818 | 12/1966 | United Kingdom | 272/134 |

OTHER PUBLICATIONS

Advertisement by Eagle Fitness Systems, Date Unknown.

*Primary Examiner*—Richard J. Apley
*Assistant Examiner*—Robert W. Bahr
*Attorney, Agent, or Firm*—Leighton K. Chong

[57] ABSTRACT

A multi-function exercise machine has a platform, a pivot support fixed to one side of the platform, a pivot lever rotatably mounted to the pivot support and having an exercise bar mounted to its upper end so as to extend over the platform, a stack of weights for applying a selected resistance to the exercise bar, a cable connected between the weight stack and the pivot lever, a plate having an array of holes at angular positions and a retaining pin for adjusting the angular position of the pivot lever on the pivot support so as to define a start position of the exercise bar above the platform, and a clamp for adjusting the length of the cable between the pivot bar and the weight stack taking into account the angular position of the pivot lever. The start position of the exercise bar is adjusted for different sizes of users and types of exercises to be performed on the exercise machine.

9 Claims, 3 Drawing Sheets

FIG. 3(a)
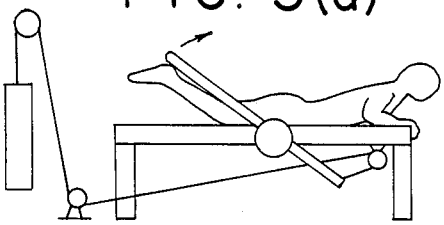
FIG. 3(b)
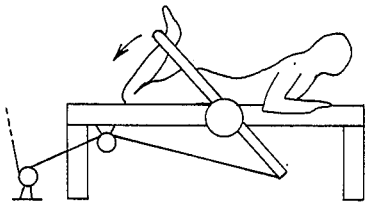
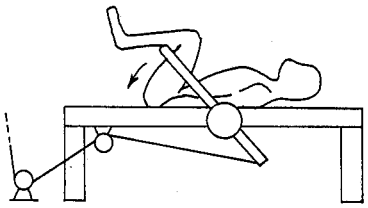
FIG. 3(c)
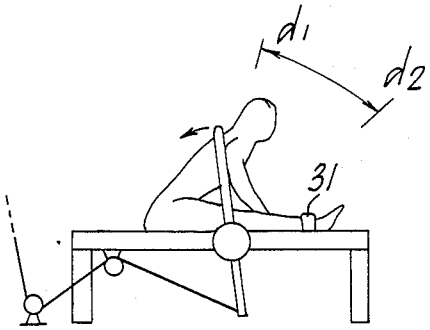
FIG. 3(d)
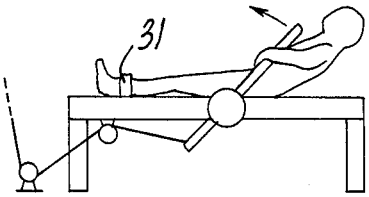
FIG. 3(e)
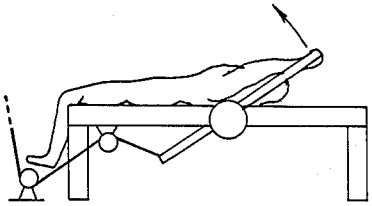
FIG. 3(f)
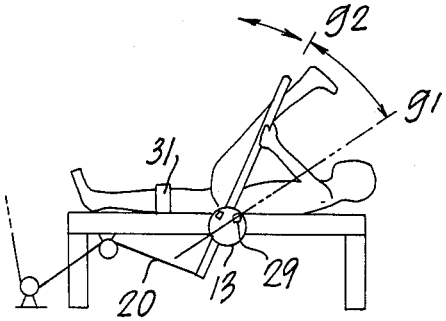
FIG. 3(g)
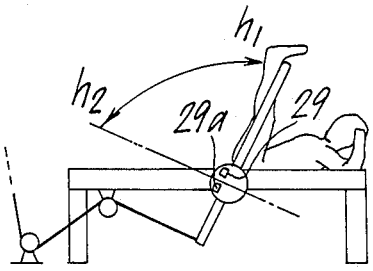
FIG. 3(h)

EXERCISE MACHINE WITH ADJUSTABLY POSITIONED BAR

FIELD OF THE INVENTION

The present invention relates to an exercise machine and particularly to a multi-function exercise machine having a weighted bar in which the start position of its travel can be adjusted for an individual user.

BACKGROUND OF THE INVENTION

In conventional exercise machines, an exercise bar is pulled or pushed from a fixed start position. For example, some machines have a bar presented in position before a standing, seated, or kneeling user who pulls the bar downward, pushes it in a direction away from the user, or pivots it laterally against a selected weight resistance. Such machines can be used for multiple types of exercises by the user assuming different positions relative to the position of the bar and to its predefined range of travel. However, these systems have the problem that the position of the bar is not adjustable to accomodate the particular size of an individual user or the type of exercise to be performed.

Moreover, conventional exercise systems are primarily directed to users standing, seated or kneeling in an upright position. For some types of exercise, such as bent leg pulling or pushing, it is highly desirable to have a machine which accomodates the user in a lying or horizontal position. Some machines employ horizontal platforms positioned under a bar which can be pulled or pushed while the user is lying down. For example, in U.S. Pat. No. 4,200,279, a horizontal platform has a pivot bar arranged at one end which is connected by cam and pulley to a stack of weights for doing knee pushing, hamstring pulling, or sit-ups. However, this machine has the pivot bar in a fixed position relative to the horizontal platform, which limits the types of horizontal exercises which can be comfortably performed and does not readily accomodate the physical dimensions of different users. Also, the pivot bar has only a fixed start position of travel which cannot be adjusted.

Another horizontal exercise machine shown in U.S. Pat. No. 4,226,415 has a horizontal platform and a pivot bar which can be adjusted in its horizontal position or vertical height above the platform. A two-way rotary hydraulic actuator is used to provide a constant resistance to the pivot motion of the bar in one or the other direction. Although the resistance bar can be adjusted in position for different types of exercises and for different dimensions of users, it has the drawback that the start position of the bar's travel cannot be preset by a user for exact repetition of a selected exercise. Instead, the bar is moved against resistance to an arbitrary end of stroke by the user and then returned to an arbitrary start of the next stroke. The inability to exactly repeat an exercise stroke has the disadvantage that the user cannot reliably gauge progress to be made by repetition of the same strokes.

SUMMARY OF THE INVENTION

The invention seeks to overcome the disadvantages of the conventional exercise machines mentioned above. A principal object of the invention is to provide an exercise machine in which the start position of a weighted bar can be adjusted by indivdual users. In particular, a specific object of the invention is to provide a horizontal multi-function exercise machine in which the user can set the start angle of a pivot bar connected to an adjustable stack of weights.

In accordance with the invention, a multi-function exercise machine comprises a platform supported in a longitudinal position, a pivot support fixed to one side of the platform, a pivot lever rotatably mounted at an intermediate portion thereof to the pivot support and having an exercise bar mounted to an upper end thereof so as to extend over the width of the platform, adjustable weight means for setting a desired level of weight resistance to be applied to the exercise bar, a coupling link connected between the weight means and a lower end of the pivot lever extending below the platform, first means for adjusting a longitudinal restraint position of the user on the platform, second means for adjusting a vertical position of the bar on the upper end of the pivot lever above the platform, third means for adjusting an angular start position of the pivot lever on the pivot support so as to define a start position of the exercise bar above the platform, and fourth means for adjusting the length of the coupling link between the lower end of the pivot bar and the weight means taking into account the angular start position of the pivot lever set by the third adjusting means.

According to a preferred embodiment of the invention, the first adjusting means of the exercise machine includes a double row of pins extending longitudinally along the sides of the platform and a belt restraining member having a pair of mounting portions attachable to a respective pair of pins at a selected longitudinal position of the platform. The second adjusting means comprises an extension member having a plurality of adjusting holes therein which is telescoped into a hollow portion in the end of the pivot lever and having a pin retainer for engaging a selected extension hole of the extension member.

For regulating the start angle position of the bar, the third adjusting means is constituted by a fixed circular plate having a plurality of holes formed. circumferentially therein and spaced at predetermined angular intervals, a pivot shaft mounted to the center of the plate, the pivot lever rotatably mounted on the shaft, and a pin retainer positioned in a selected hole for abutting the pivot lever at a selected angular start position. The fourth adjusting means for the length of the coupling link is formed by a cable having an end looped around a bar on the lower end of the pivot lever, and a clamping member on the end for clamping it to the cable.

The invention also includes a release mechanism for locking the pivot lever in any position in the event it becomes necessary for the user to stop an exercise or to release the weight midway through an exercise stroke.

BRIEF DESCRIPTION OF THE DRAWINGS

The above objects, features, and advantages of the invention are described in detail below, in conjunction with the drawings, of which:

FIGS. 3(*a*) to 3(*h*) illustrate the use of the exercise machine of the invention to perform various types of exercises.

DETAILED DESCRIPTION OF THE INVENTION

Figure 1:
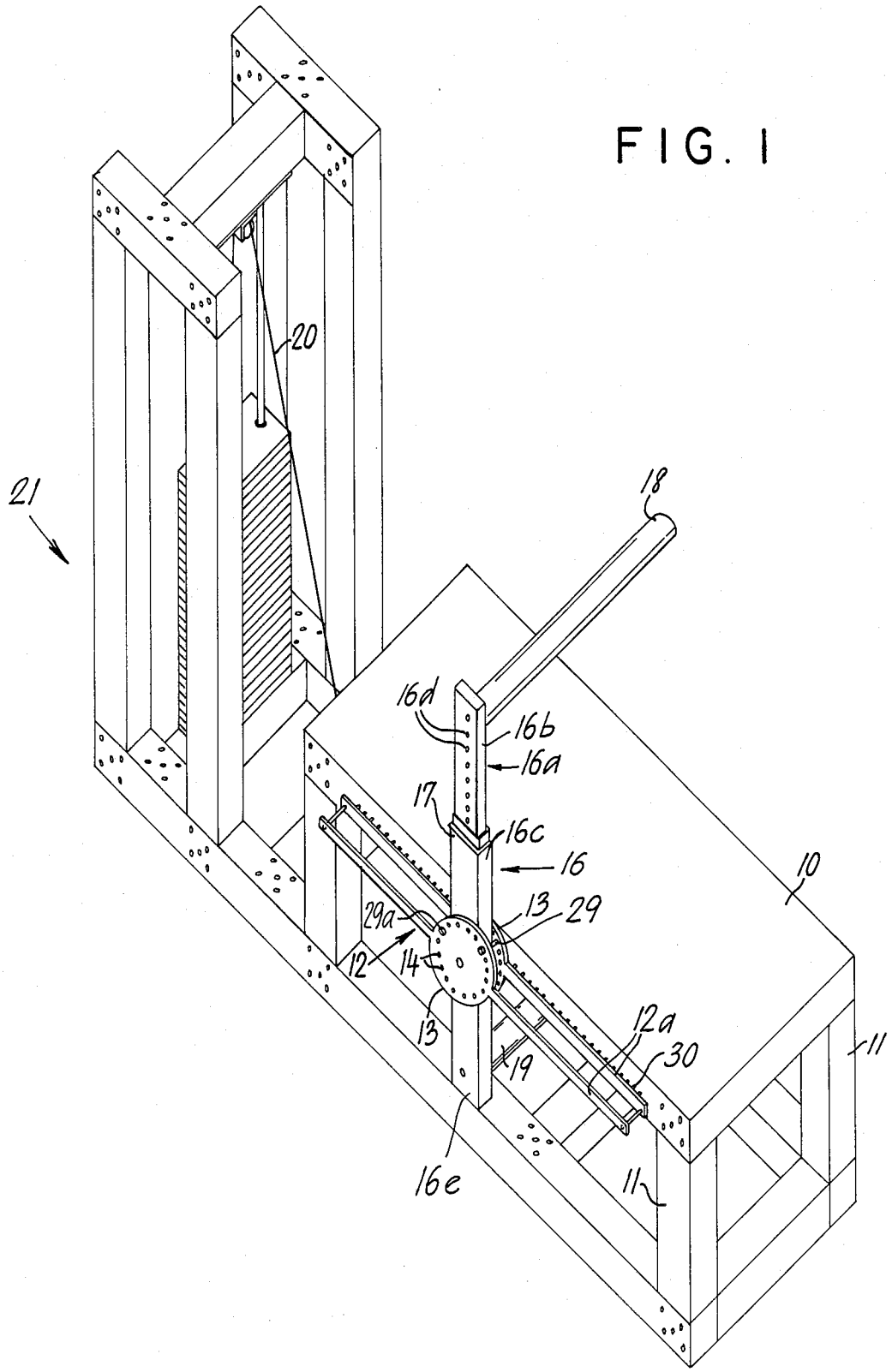
FIG. 1 is a perspective view of a multi-function exercise machine in accordance with the invention.

Referring to FIG. 1, the general concept of the invention is shown in perspective view. A multi-function exercise machine has a platform 10 supported horizontally on legs 11. On one side, a pivot support 12 is fixed to the platform. The pivot support has a pair of circular plates 13 rigidly fixed together through a pair of support rails 12*a*. The plates 13 have an array of correspondng holes 14 perforated through each plate along a circumferential portion thereof. A pivot shaft 15 is journalled in the center of the plates, and a pivot lever 16 is rotatably mounted on the pivot shaft 15. The upper end 16*a* of the pivot lever has an adjustable extension member 16*b* telescopingly mounted in a hollow section 16*c*. The extension member 16*b* has a number of holes 16*d* along its length, and the length of extension is set by pin 17 inserted through a retaining hole in the hollow section 16*c* into a selected extension hole 16*d*.

An exercise bar 18 is mounted to the end of the extension member 16*b* and extends across the width of the platform 10. Different types of exercises are performed by a user lying prone or supine or sitting on the platform 10 and pushing or pulling on the bar with a pivoting or rotational movement. The other end 16*e* of the pivot lever 16 extends below the platform and has lower width-wise extending bar 19 parallel to the exercise bar 18. The lower bar 19 is connected by a coupling link, for example, in the form of a cable 20 to a stack of weights 21. In the use of the exercise machine, a desired weight level is selected by the user, and then the user performs a desired type of exercise on the platform by pulling or pushing the exercise bar 18 against the selected weight.

Figure 2:
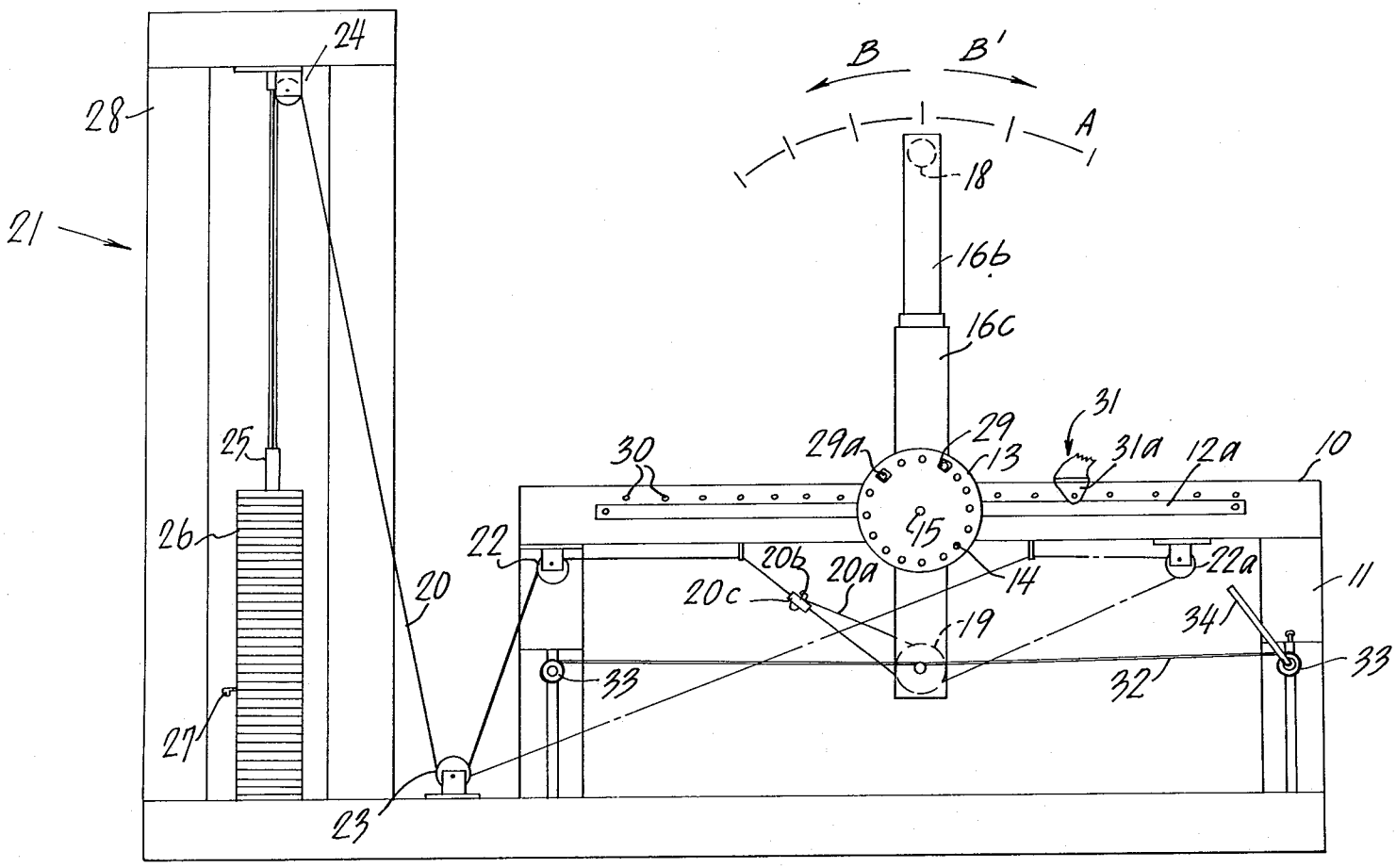
FIG. 2 shows a particular embodiment of the exercise machine of FIG. 1 shown in greater detail.

Shown in greater detail in FIG. 2, the angular start position for the stroke of pivot lever 16 can be set at any desired position, indicated by the arc A, depending on the type of exercise to be performed and the therapeutic effect desired by the user. The user inserts a pin 29 through the holes 14 of the plates 13 corresponding to a desired angular start position (shown in the drawings as the position perpendicular to the platform). The pivot lever 16 abuts against the pin 29 to mark the selected start position. The length of the cable 20 connecting the lower end 16*e* to the weight stack is then adjusted to remove any undesired slack in the cable. The cable 20 has an end 20*a* looped around the lower bar 19 and clamped by a cinch 20*b* to a movable sleeve 20*c* fixed on the cable. Alternatively, the coupling link can take the form of a segmented chain, and the length thereof is adjusted by inserting a hook on the end of the chain in an appropriate segment of the chain.

The cable 20 is trained around pulleys 22, 23, 24 and fixed at its other end to a lifting member 25 in the form of a rod extending through central holes vertically aligned through the stack of weight bars 26. The desired amount of weight bars is attached to the lifting member 25 by a pin 27 which is inserted under a groove of the lowest weight bar into a corresponding hole in the lifting member 25. The pulley 24 is mounted vertically above the weight stack to a frame 28. The weights exert a pulling force through cable 20 on the pivot lever end 16*e*, and provides resistance against the upper end of the pivot lever being moved in the direction B. Conversely, the cable 20 can be trained over pulley 22*a* (indicated by phantom line) to pull the pivot lever from the opposite direction so that weighted resistance is provided in the direction B'.

For adjusting the position the user on the platform, two rows of pins 30 are provided along the sides of the platform 10. A part of the body of the user, such as the waist, knees, or ankles, is restrained at a selected longitudinal position by a belt 31 which is attached to a corresponding pair of pins on the sides of the platform through belt mounting portions 31*a*.

Another feature of the invention is a mechanism for locking the pivot lever in the event of an emergency in which the user must stop an exercise midway in a stroke or release the weight from the bar. A chain 32 is wound at both ends around rotatable reels 33. The ends of the chain are terminated on the reels. The reels 33 are spring biased in opposite directions so that the chain is biased to be rewound on the reels with a slight tension. The lower end of the pivot bar 16*e* is attached to a middle section of the chain 32, for example, by looping the chain over a shaft portion of the lower bar 19 and pegging the chain to the shaft. As the upper bar of the pivot lever 16 is pivoted in one direction, the lower bar moves correspondingly in the opposite direction and pulls the chain along such that it unwinds from one reel and winds up on the other reel.

Each end of the chain 32 is wound with sufficient additional length so that the chain can traverse in either direction at least as far as the maximum range of travel of the pivot lever over the platform. One of the reels (on the right side of FIG. 2) is provided with a ratchet mechanism and a lever 34 which can be pulled to engage the ratchet and lock the reel against turning. This locks the chain 32, and thereby the pivot lever end 16*e*, against the force of the weights pulling on cable 20. With the chain thus locked, the weights are released from the user, and the user can safely dismount from the platform.

The exercise machine of the invention can be used for a variety of exercises. As illustrated in FIGS. 3(*a*) and 3 (*b*), hamstring pulling or bent leg pushing exercises can be performed with the user lying prone on the platform and pulling or pushing on the bar by the ankles. In FIG. 3(*c*), a bent knee pushing exercise is performed with the user lying supine and pushing against the bar by the back of the knees.

In FIG. 3(*d*), a back strengthening exercise is performed with the user sitting on the platform and pushing against the bar with the back. This exercise makes a particularly advantageous use of the invention, as the start position of the back pushing stroke and the height of the exercise bar can be adjusted for the comfort of the user or the particular muscles (upper or lower back) desired to be strengthened. Moreover, as the back is exercised and becomes increasingly flexible, the user can increase the angular setting of he start position of the bar and measure progress by reference to the increasing start position. Thus, for example, a person with a stiff back may initially exercise by setting the start position to a relatively low angular position d1 in FIG. 3(*d*). As the user exercises and the back becomes increasingly flexible, the angular setting can be increased to position d2 or beyond. The ability to regulate the machine in order to progressively exercise a body part is an important advantage of the present invention. This is particularly true for back exercises performed on the disclosed machine, insofar as conventional machines do not provide or cannot be readily adapted for the performance of such back exercises. A stomach strengthening exercise is shown in FIG. 3(*e*) with the user similarly sitting up against the weight of the bar on the chest, and an arm pullover exercise is shown in FIG. 3(*f*).

The exercise machine of the invention can also be used to progressively stretch a body part of the user during the same set of an exercise. For example, as shown in FIG. 3(*g*), the user performs a leg stretch exercise by setting the start position (and the length of cable 20) initially to position g1, then attaching the belt restraint 31 to one leg, pushing the bar with the user's arms to a low angular setting g2 and inserting the other leg behind the bar. The user then exercises the leg by pushing against the weight of the bar and allowing the return weight of the bar to stretch the leg muscles from position g2 gradually back to the start position g1. As a safeguard against tearing muscle tissue, the user can reset the start position pin, while still on the platform, by withdrawing it from the high angular setting g1 and resetting it to a lower angular position such as g2 or some intermediate position. Thus, the bar is prevented from returning beyond the readjusted start position g2, thereby preventing muscle tearing and allowing the leg muscles to be stretched safely at the low angular position. As the muscles are warmed up and become more flexible, the user can then reset the start position progressively from the platform until the desired amount of maximum stretch at the initial start position g1 is achieved.

By inserting a second pin 29*a* into the plates 13, the user can also set a stop position for the exercise machine. This is advantageous for an exercise in which it is desired to set a stop position to prevent one body part from hitting another during an exercise. For example, as shown in FIG. 3(*h*), a side leg stretch exercise can be performed in which both a start position h1 and a stop position h2 are set. The start setting prevents the return weight from stretching the leg beyond position h1, and the stop setting prevents the user from hitting the exercised leg against the other leg during a power stroke against the bar.

Thus, the exercise machine having the adjustably positioned exercise bar of the invention is capable of being used for a wide range of exercises, for a variety of physical sizes of users, and for stretching or increasing body flexibility safely. The belt restraint adjustment allows the user's body to be secured at any desired longitudinal position of the platform according to the type of exercise to be performed. Similarly, the upright extension of the bar is adjustable to accomodate different physical sizes of users and types of exercises. As described previously, the start angle and coupling link adjustments permit the exercise bar to be moved from a selected start angle according to a particular exercise or therapeutic effect desired by the user. The stop position can also be set to prevent injury to a body part at the end of a power stroke against the bar. Moreover, the adjustment mechanisms and the configuration of the machine are also designed for inexpensive and convenient assembly. The weight release mechanism also provides an additional safety feature in the use of the machine.

Although a preferred embodiment of the invention has been described above, it should be understood that many variations and modifications are possible within the disclosed principles of this invention. For example, the platform can be made slidable along a horizontal rack to shift the position of the user relative to the exercise bar, or can be made to incline at various angles. The adjusting devices, particularly the start and stop position adjustments, can of course be carried out by other equivalent means. The structure of the mechanism providing weight resistance can be modified in various ways or substituted with other forms of applying mechanical resistance. It is intended that the embodiment described herein and all such variations and modifications be included within the scope of the invention, as defined in the following claims.

I claim:

1. A multi-function exercise machine having an adjustably positioned exercise bar comprising:

a platform supported in a longitudinal position;

a pivot support fixed to one side of the platform;

a pivot lever rotatably mounted to the pivot support and having an exercise bar mounted to an upper end thereof so as to extend transversely over the platform;

weight resistance means for setting a desired level of weight resistance to be applied to the exercise bar;

coupling means connected between the weight resistance means and a portion of the pivot lever for applying a selected weight resistance against pivotal movement of the exercise bar mounted on the upper end of the pivot lever;

first means for adjusting a first angular position of the pivot lever on the pivot support so as to define a start position at the beginning of an exercise stroke of the exercise bar above the platform;

second means for adjusting the coupling means between the pivot lever and the weight resistance means taking into account the angular position of the pivot lever set by the first adjusting means; and stop adjusting means for variably adjusting a second angular position of the pivot lever spaced angularly from the first position in order to define a stop position of the exercise bar at the end of the exercise stroke in one direction against the resistance of the weight resistance means, whereby a user of the exercise machine can selectively set different start and stop positions of the exercise stroke in one direction to vary an exercise performed by pulling or pushing against the exercise bar in the one direction to the stop position and then releasing the exercise bar on the return stroke back to the start position, wherein said first means for adjusting the start position and said stop adjusting means for adjusting the stop position of the exercise stroke of said exercise bar includes said pivot support having a fixed circular plate provided with a plurality of holes formed circumferentially therein and spaced at predetermined angular intervals, wherein a range of angular movement of said exercise bar for a desired exercise stroke is adjustably set between a first selected hole at a first angular position and a second selected hole at a second angular position, a first pin retainer insertable in the first selected hole against which said pivot lever is abutted at the start position, and a second pin reatainer insertable in the second selected hole to which said exercise bar is moved at the stop position of the exercise stroke.

2. An exercise machine according to claim 1, further comprising third means arranged along a side of the platform for adjusting a longitudinal restraint position for attaching restraining means to the platform.

3. An exercise machine according to claim 2, wherein the third adjusting means of the exercise machine includes two rows of pins extending longitudinally along the sides of the platform and a belt restraining member having a pair of mounting portions attachable to a respective pair of pins at a selected longitudinal position of the platform.

4. An exercise machine according to claim 1, further comprising fourth means on the upper end of the pivot lever for adjusting an extension of the exercise bar above the platform.

5. An exercise machine according to claim 4, wherein the fourth adjusting means comprises an extension member having a plurality of adjusting holes therein which is telescoped into a hollow portion in the upper end of the pivot lever and a pin retainer for engaging a selected extension hole of the extension member.

6. An exercise machine according to claim 1, wherein said weight resistance means comprises a stack of weight bars selectively attachable to a lifting member which is connected to said coupling means.

7. An exercise machine according to claim 1, wherein said platform is supported in a horizontal position.

8. An exercise machine comprising:

a platform supported in a longitudinal position;

a pivot support fixed to one side of the platform;

a pivot lever rotatably mounted at an intermediate portion thereof to the pivot support and having an exercise bar mounted to an upper end thereof so as to extend transversely over the platform;

weight resistance means for setting a desired level of weight resistance to be applied to the exercise bar;

coupling means connected between the weight resistance means and a lower end of the pivot lever extending below the platform for applying a selected weight resistance against pivotal movement of the exercise bar mounted on the upper end of the pivot lever;

first means for adjusting an angular position of the pivot lever on the pivot support so as to define a start position of the exercise bar above the platform; and second means for adjusting a length of the coupling means between the lower end of the pivot lever and the weight resistance means taking into account the angular position of the pivot lever set by the first adjusting means, wherein the coupling means includes a cable having an end looped around a lower bar mounted on the lower end of the pivot lever, and the second adjusting means includes a clamping member on the cable end for clamping it at an adjustable position of the cable.

9. An exercise machine comprising:

a platform supported in a longitudinal position;

a pivot support fixed to one side of the platform;

a pivot lever rotatably mounted at an intermediate portion thereof to the pivot support and having an exercise bar mounted to an upper end thereof so as to extend transversely over the platform;

weight resistance means for setting a desired level of weight resistance to be applied to the exercise bar;

coupling means connected between the weight resistance means and a lower end of the pivot lever extending below the platform for applying a selected weight resistance against pivotal movement of the exercise bar mounted on the upper end of the pivot lever;

first means for adjusting an angular position of the pivot lever on the pivot support so as to define a start position of the exercise bar above the platform;

second means for adjusting a length of the coupling means between the lower end of the pivot lever and the weight resistance means taking into account the angular position of the pivot lever set by the first adjusting means; and a release mechanism for locking the pivot lever which includes a second coupling means having one end fixed to the lower end of the pivot lever and its other end wrapped around a rotatable reel mounted to the platform, said reel being spring biased to wind the coupling means onto the reel, said coupling means being unwound from the reel as said pivot lever is moved, and locking means for locking the reel from rotation in order to lock the pivot lever from movement.

* * * * *